US006494629B2

(12) United States Patent
Hayashi et al.

(10) Patent No.: US 6,494,629 B2
(45) Date of Patent: Dec. 17, 2002

(54) DATA PROCESSING METHOD FOR ELIMINATING INFLUENCE OF HEAT ACCUMULATION IN THERMAL HEAD OF THERMAL PRINTER

(75) Inventors: Shinji Hayashi, Saitama (JP); Hisashi Enomoto, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 72 days.

(21) Appl. No.: 09/822,253

(22) Filed: Apr. 2, 2001

(65) Prior Publication Data

US 2001/0031165 A1 Oct. 18, 2001

(30) Foreign Application Priority Data

Mar. 31, 2000 (JP) ..... 2000-098923

(51) Int. Cl.[7] ..... B41J 2/315
(52) U.S. Cl. ..... 400/120.14; 347/195
(58) Field of Search ..... 400/120.14, 120.15, 400/124.13, 120.09; 347/188, 202, 204, 206, 194–195

(56) References Cited

U.S. PATENT DOCUMENTS 5,324,121 A * 6/1994 Sasaki et al. ..... 347/188
5,661,513 A * 8/1997 Shirakawa et al. ..... 347/202
5,800,075 A 9/1998 Katsuma et al. ..... 400/120
6,108,019 A 8/2000 Katsuma et al. ..... 347/188

* cited by examiner

*Primary Examiner*—John S. Hilten
*Assistant Examiner*—K. Feggins
(74) *Attorney, Agent, or Firm*—Sughrue Mion, PLLC

(57) ABSTRACT

There is disclosed a data processing method for correcting heating data for a thermal head of a thermal printer, to eliminate influence of heat energy accumulated in first to Nth heat accumulating layers of the thermal head. Basic heating data of a subject line is corrected with first to Nth correction data obtained by multiplying first to Nth heat accumulation data by predetermined coefficients respectively. The heating elements are driven in accordance with the corrected heating data, to print the subject line. A drive voltage to be applied across heating elements of the thermal head is determined at the start of printing a frame of image, according to an environmental temperature around the thermal head and a head temperature measured through a thermistor mounted in the Nth heat accumulating layer of the thermal head. The Nth coefficient is calculated according to a formula that includes the head drive voltage as a parameter.

15 Claims, 5 Drawing Sheets

DATA PROCESSING METHOD FOR ELIMINATING INFLUENCE OF HEAT ACCUMULATION IN THERMAL HEAD OF THERMAL PRINTER

BACKGROUND OF THE INVENTION

1. Field of the Invention

The present invention relates to a data processing method for correcting heating data for a thermal head of a thermal printer, to eliminate influence of heat energy accumulated in the thermal head such that print quality may not be degraded by the heat accumulation. The present invention relates also to a data processing apparatus for this method.

2. Background Arts

There are thermosensitive recording type thermal printers and thermal transfer type thermal printers. The former heats a thermosensitive recording sheet directly with a thermal head, to cause the sheet to develop color. The latter heats the back of an ink ribbon placed upon a recording sheet to transfer ink to the recording sheet. The thermal printer has a thermal head which has an array of heating elements arranged on a ceramic substrate. The array of heating elements correspond to a line of pixels, and the heating elements are each individually driven to record a dot at a time, as the recording sheet is conveyed in a perpendicular direction to the heating element array. Thus an image is printed line by line on the recording sheet. Hereinafter, the direction along which the heating element array extends will be called a main scan direction, whereas the direction along which the recording sheet is conveyed will be called a sub scan direction.

In the thermosensitive recording type and sublimation ink transfer type thermal printing, one dot constitutes one pixel of the printed image, and has a variable density including a zero level, that is designated by image data for each pixel. However, where the heating elements are driven simply in accordance with the image data, the densities of the dots can deviate from the designated densities because of heat accumulation in the thermal head.

Most of heat energy generated from the heating elements is used for recording, but the rest stays unused or dissipates. The unused heat energy is mainly accumulated in a glazing layer which is formed between the heating elements and ceramic substrate. Part of the accumulated heat energy is transmitted from the glazing layer to the ceramic substrate and is accumulated therein, or partly transmitted further to an aluminum plate supporting the substrate and is accumulated therein. From the aluminum plate, the heat energy is partly transmitted to a radiation plate, and radiates from the radiation plate. Hereinafter, the layers disposed under the heating elements will be referred to as heat accumulating layers. The heat energy accumulated in this way is partly transmitted back to the heating elements and added to the heat energy presently generated from the heating elements, thereby rising the densities of the dots from the designated values. Where density should change steeply from high to low, the change becomes gentler in the printed image, so the contour or edge of the printed image becomes vague. Since the heat accumulation in the thermal head gradually increases as the recording proceeds, it results a gradual density change overall the printed image, called shading. That is, the density is generally low at the start of recording, and as the recording proceeds, it becomes higher as a whole.

In order to prevent the above mentioned degrading of the printed image caused by the heat accumulation, U.S. Pat. No. 5,800,075 suggests a data processing method, wherein the heat accumulation in the respective heat accumulating layers of the thermal head is estimated on the basis of input image data, and the input image data is corrected with correction data determined for each pixel based on the estimated heat accumulation.

According to this method, because the heat energy values transmitted to the heat accumulating layers are calculated by linear conversion of the generated heat energy values, if a high density area, e.g. black characters or lines, is included in a middle density area, peripheral portions around the high density area have higher densities than expected, and the image quality is degraded.

The thermal printers also have a problem that the environmental temperature has influence on the densities of the printed dots because the heat energy generated from the heating elements of the thermal head is transmitted to and diffused in the ink ribbon, the recording sheet, a platen roller, a platen drum or the like. That is, if the environmental temperature is pretty high or low, the dot densities get higher or lower than expected, even while the heat energy generated from the heating elements is proper. As a solution for this problem, it is known in the art to adjust voltage applied to the thermal head depending upon the temperature of the thermal head and the environmental temperature.

Since the above data processing method is on the presumption that the head drive voltage applied to the thermal head is kept unchanged, this method rather causes a problem where the head drive voltage is changed according to the temperature of the thermal head and the environmental temperature. That is, the dot densities would deviate from the designated values as the recording proceeds.

SUMMARY OF THE INVENTION

In view of the foregoing, an object of the present invention is to provide a data processing method for correcting heating data for a thermal head and an apparatus therefor, whereby the influence of heat accumulation in the thermal head on the recording density is well eliminated taking account of head drive voltage applied to the thermal head.

Another object of the present invention is to provide a data processing method for correcting heating data for a thermal head to eliminate influence of heat accumulation in the thermal head on recording density, and an apparatus therefor, whereby conditions of heat energy accumulated in the respective heat accumulating layers are estimated with high accuracy, taking account of heat transmission properties between the heat accumulating layers, and thus the influence of heat accumulation on the recording density is well eliminated.

On the assumption that a thermal head has an array of heating elements arranged in a line and first to Nth heat accumulating layers disposed under the heating elements in this order from the side of heating elements, and the heating elements are driven in accordance with corrected heating data, to print one line after another on a recording sheet, one pixel of each line corresponding to one heating element of the array in regular sequence, and that a drive voltage to be applied across the heating elements is determined according to a temperature of the Nth heat accumulating layer and an environmental temperature around the thermal head, a data processing method of the present invention comprising the steps of:

A. determining first to (N−1)th coefficients for the first to (N−1)th heat accumulating layers based on heat transmission properties between the first to Nth heat accumulating layers, and a Nth coefficient for the Nth heat accumulating layer based on the drive voltage for the thermal head and on the heat transmission properties between the first to Nth heat accumulating layers;

B. obtaining first to Nth correction data for each pixel of a subject line to print, by multiplying first to Nth heat accumulation data by the first to Nth coefficients respectively, the first to Nth heat accumulation data being representative of heat accumulation amounts in the first to Nth heat accumulation layers respectively, and previously stored in relation to each heating element of the array;

C. obtaining corrected heating data for each pixel of the subject line, from basic heating data representative of a heat energy value to be applied to the recording sheet for recording the pixel and the first to Nth correction data for the pixel;

D. obtaining a new series of first heat accumulation data by multiplying the corrected heating data of the subject line by a coefficient, multiplying the previously stored first heat accumulation data by a coefficient, and adding multiplication results in pixel-to-pixel correspondence;

E. obtaining a new series of Jth heat accumulation data, J being 2 to N, by multiplying the previously stored (J−1)th heat accumulation data by a coefficient, multiplying the previously stored Jth heat accumulation data by a coefficient, and adding multiplication results in pixel-to-pixel correspondence; and F. storing the new series of first to Nth heat accumulation data in place of the previously stored first to Nth heat accumulation data, while the subject line is printed in accordance with the corrected heating data.

The above steps B to F are repeated for each line to print.

In this way, the drive voltage for the thermal head is taken into consideration on determining the Nth correction data, so the corrected heating data is effective for printing the data at the expected density even where the drive voltage is changed according to the head temperature and the environmental temperature.

A data processing apparatus of the present invention comprises:

a voltage determining means for determining a drive voltage to be applied to the thermal head, according to a temperature of the Nth heat accumulating layer and an environmental temperature around the thermal head;

a memory means for storing first to Nth heat accumulation data in relation to each heating element of the array, the first to Nth heat accumulation data being representative of heat accumulation amounts in the first to Nth heat accumulation layers respectively;

first to Nth multipliers multiplying the first to Nth heat accumulation data by first to Nth coefficients respectively, to obtain first to Nth correction data for each pixel of a subject line to print;

a coefficient determining means for determining the Nth coefficient based on heat transmission properties between the first to Nth heat accumulating layers, and on the drive voltage for the thermal head;

a correcting means for correcting basic heating data of the subject line, with the first to Nth correction data and a coefficient in pixel-to-pixel correspondence, to produce corrected heating data of the subject line, the basic heating data being representative of a heat energy value for each pixel to be applied to the recording sheet for recording the pixel;

a first calculator for obtaining a new series of first heat accumulation data by multiplying the corrected heating data of the subject line by a coefficient, multiplying the previously stored first heat accumulation data by a coefficient, and adding multiplication results in pixel-to-pixel correspondence; and second to Nth calculators for obtaining a new series of Jth heat accumulation data, J being 2 to N, by multiplying the previously stored (J−1)th heat accumulation data by a coefficient, multiplying the previously stored Jth heat accumulation data by a coefficient, and adding multiplication results in pixel-to-pixel correspondence, wherein the new series of first to Nth heat accumulation data are written on the memory device in place of the previously stored first to Nth heat accumulation data, during the printing of the subject line, and are used for obtaining first to Nth correction data for a next line to print.

According to another aspect of the present invention, a data processing method for correcting heating data for a thermal head to eliminate influence of heat accumulation in the thermal head on recording density, comprises the steps of:

A. obtaining first to Nth correction data for each pixel of a subject line to print, by multiplying first to Nth heat accumulation data by first to Nth coefficients respectively, the first to Nth heat accumulation data being representative of heat accumulation values in the first to Nth heat accumulation layers respectively, and previously stored in relation to each heating element of the array;

B. obtaining corrected heating data for each pixel of the subject line, from basic heating data representative of a heat energy value to be applied to the recording sheet for recording the pixel and the first to Nth correction data for the pixel;

C. converting the corrected heating data for the subject line, into modified heating data through a non-linear function that is predetermined based on heat transmission properties between the heating elements and the first heat accumulating layer;

D. obtaining a new series of first heat accumulation data by multiplying the modified heating data of the subject line by a coefficient, multiplying the previously stored first heat accumulation data by a coefficient, and adding multiplication results in pixel-to-pixel correspondence;

E. obtaining a new series of Jth heat accumulation data, J being 2 to N, by multiplying the previously stored (J−1)th heat accumulation data by a coefficient, multiplying the previously stored Jth heat accumulation data by a coefficient, and adding multiplication results in pixel-to-pixel correspondence; and F. storing the new series of first to Nth heat accumulation data in place of the previously stored first to Nth heat accumulation data, while the subject line is printed in accordance with the corrected heating data.

The above steps A to F are repeated for each line to print.

Since the heat accumulation data for the first heat accumulating layer is determined based on the modified heating data that is obtained by converting the corrected heating data for the subject line through a non-linear function that is predetermined based on heat transmission properties between the heating elements and the first heat accumulating layer, conditions of heat energy accumulated in the respective heat accumulating layers are estimated with high accuracy.

According to a preferred embodiment of the invention, the heat accumulating layers of the thermal head comprise a glazing layer, a ceramic substrate and an aluminum plate laid on one another in this order from the side of heating element, and the glazing layer is hypothetically divided into a number of heat accumulating layers arranged vertically from each other, to obtain the heat accumulation data and the correction data for each of the hypothetically divided heat accumulating layers. Thereby, thermal conductivity of the glazing layer is taken into consideration on estimating condition of heat energy accumulated in the glazing layer.

A data processing apparatus for correcting heating data for a thermal head to eliminate influence of heat accumulation in the thermal head on recording density, the thermal head having an array of heating elements arranged in a line and first to Nth heat accumulating layers disposed under the heating elements in this order from the side of heating elements, the heating elements being driven in accordance with corrected heating data, to print one line after another on a recording sheet, one pixel of each line corresponding to one heating element of the array in regular sequence, the data processing apparatus comprising:

a memory means for storing first to Nth heat accumulation data in relation to each heating element of the array, the first to Nth heat accumulation data being representative of heat accumulation values in the first to Nth heat accumulation layers respectively;

first to Nth multipliers for multiplying the first to Nth heat accumulation data by first to Nth coefficients respectively, to obtain first to Nth correction data for each pixel of a subject line to print;

a correcting means for correcting basic heating data of the subject line, with the first to Nth correction data and a coefficient in pixel-to-pixel correspondence, to produce corrected heating data of the subject line, the basic heating data being representative of a heat energy value for each pixel to be applied to the recording sheet for recording the pixel;

a conversion means for converting the corrected heating data for the subject line, into modified heating data through a non-linear function that is predetermined based on heat transmission properties between the heating elements and the first heat accumulating layer;

a first calculator for obtaining a new series of first heat accumulation data by multiplying the corrected heating data of the subject line by a coefficient, multiplying the previously stored first heat accumulation data by a coefficient, and adding multiplication results in pixel-to-pixel correspondence; and second to Nth calculators for obtaining a new series of Jth heat accumulation data, J being 2 to N, by multiplying the previously stored (J−1)th heat accumulation data by a coefficient, multiplying the previously stored Jth heat accumulation data by a coefficient, and adding multiplication results in pixel-to-pixel correspondence, wherein the new series of first to Nth heat accumulation data are written on the memory device in place of the previously stored first to Nth heat accumulation data, during the printing of the subject line, and are used for obtaining first to Nth correction data for a next line to print.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
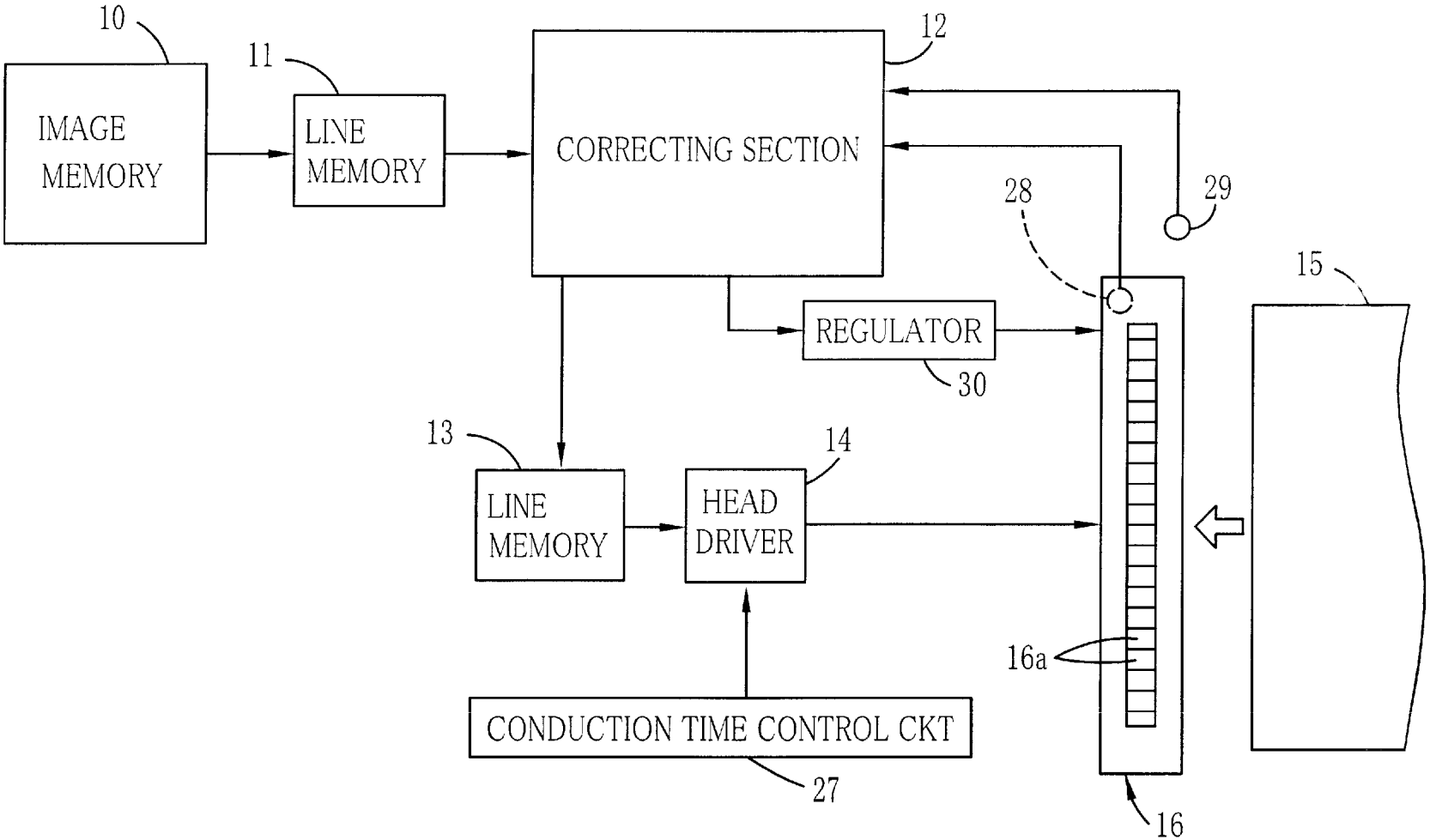
FIG. 1 is a block diagram illustrating essential parts of a thermosensitive recording type thermal printer embodying the present invention.

FIG. 1 shows essential parts of a thermosensitive recording type color thermal printer embodying the present invention. Image data of an image to print is picked up through a digital camera or a scanner, and written on an image memory 10 separately for each of three colors. On printing, the image data of one color is read out from the image memory 10 in a line sequential fashion, and is written on a line memory 11. The image data of one line is serially transferred from the line memory 11 to a correcting section 12, and is corrected so as to eliminate influence of heat accumulation in a thermal head 16, as will be described in detail later. The corrected image data is written on a second line memory 13.

Based on the corrected image data written on the second line memory 13, a head driver 14 drives the thermal head 16 to record a line of dots on a thermosensitive recording sheet 15. As well known, the thermal head 16 has a number of heating elements 16*a* arranged in a line, called a main scan direction.

The thermosensitive recording sheet 15 has thermosensitive coloring layers for yellow, magenta and cyan layered in this order from an obverse side on which the heating elements 16*a* of the thermal head 16 are pressed during the recording. The thermosensitive recording sheet 15 is conveyed back and forth in a sub scan direction perpendicular to the main scan direction through a not-shown paper conveying mechanism. In this embodiment, the thermosensitive recording sheet 15 reciprocates three times to record yellow, magenta and cyan frames of one full-color image in this order in a frame sequential fashion. As conventional, the yellow and magenta thermosensitive coloring layers lose their coloring ability when exposed to ultraviolet rays of specific wavelength ranges for each color. After the yellow frame is recorded, the yellow thermosensitive coloring layer is exposed to the ultraviolet rays of the specific wavelength range that is projected from a not-show optical fixing device. After the magenta frame is recorded, the magenta thermosensitive coloring layer is exposed to the ultraviolet rays of the specific wavelength range that is projected from a not-show optical fixing device.

The thermosensitive recording performs bias heating and image or gradation heating to record a dot of one color. The bias heating is to heat the thermosensitive recording sheet 15 up to a degree slightly less than a coloring point of the corresponding coloring layer at which the color begins to develop. For the bias heating, all heating elements 16a are uniformly heated by bias data. The bias data principally represents the same value for all heating elements, and is determined for each color according to the coloring characteristics of the individual coloring layer. However, if there is any variance between resistance values of the heating elements 16*a*, the bias data is adjusted to compensate for the variance. The gradation heating is to heat the thermosensitive recording sheet 15 by a degree that corresponds to a designated coloring density. That is, the gradation heating is performed in accordance with the image data. Hereinafter, a combination of the bias data and the image data will be called heating data.

It is to be noted that the heating data corresponds to the image data in the thermal transfer recording, since the thermal transfer recording performs only the gradation heating.

In this embodiment, each heating element 16*a* is driven intermittently a number of times per pixel, and the head driver 14 controls the number of times of driving cycles for each heating element 16*a* as well as the driving length per one cycle, to generate a variable amount of heat energy in accordance with the heating data. The driving length per one cycle is controlled by a conduction time control circuit 27. However, it is possible to control either the number of driving times or the length of conduction time alone for each heating element 16*a*, in accordance with the heating data.

Figure 2:
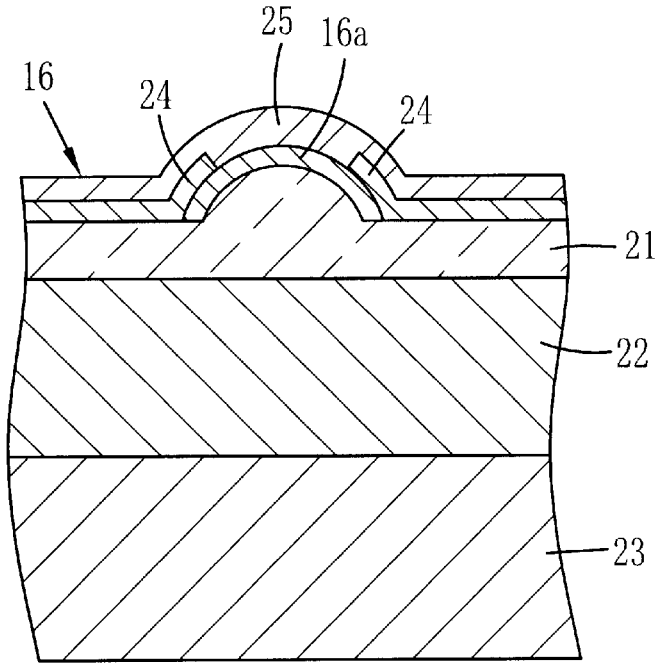
FIG. 2 is a fragmentary sectional view of a thermal head of the thermosensitive color printer.

As shown in FIG. 2, each heating element 16*a* is a resistance heating film which is connected to a pair of electrodes 24. The heating elements 16a and the electrodes 24 are disposed on a glazing layer 21 that is formed on a ceramic substrate 22, and an aluminum plate 23 is disposed on a back side of the ceramic substrate 22 opposite from the glazing layer 21. The heating elements 16*a* and the electrodes 24 are covered with a protection layer 25. The glazing layer 21, the ceramic substrate 22 and the aluminum plate 23 constitute the heat accumulating layers as defined in the description of the prior arts.

Referring back to FIG. 1, a head temperature sensor 28 is put in a recess of the aluminum plate 23. The heat temperature sensor 28 is fixed to the aluminum plate 23 through an adhesive material with a high thermal conductivity, for accurate measurement of the temperature of the aluminum plate 23. An environmental temperature sensor 29 is disposed in the vicinity of the thermal head 16, for measuring temperature around the thermal head 16. For example, thermistors are used as these temperature sensors 28 and 29. Signals from the temperature sensors 28 and 29 are sent to the correcting section 12.

On the basis of the signals from the temperature sensors 28 and 29, the correcting section 12 determines a head drive voltage Vp applied to the respective heating elements 16*a* of the thermal head 16, and sends head voltage data representative of the determined head drive voltage Vp to a regulator 30. The regulator 30 adjusts the head drive voltage Vp according to the head voltage data.

Figure 3:
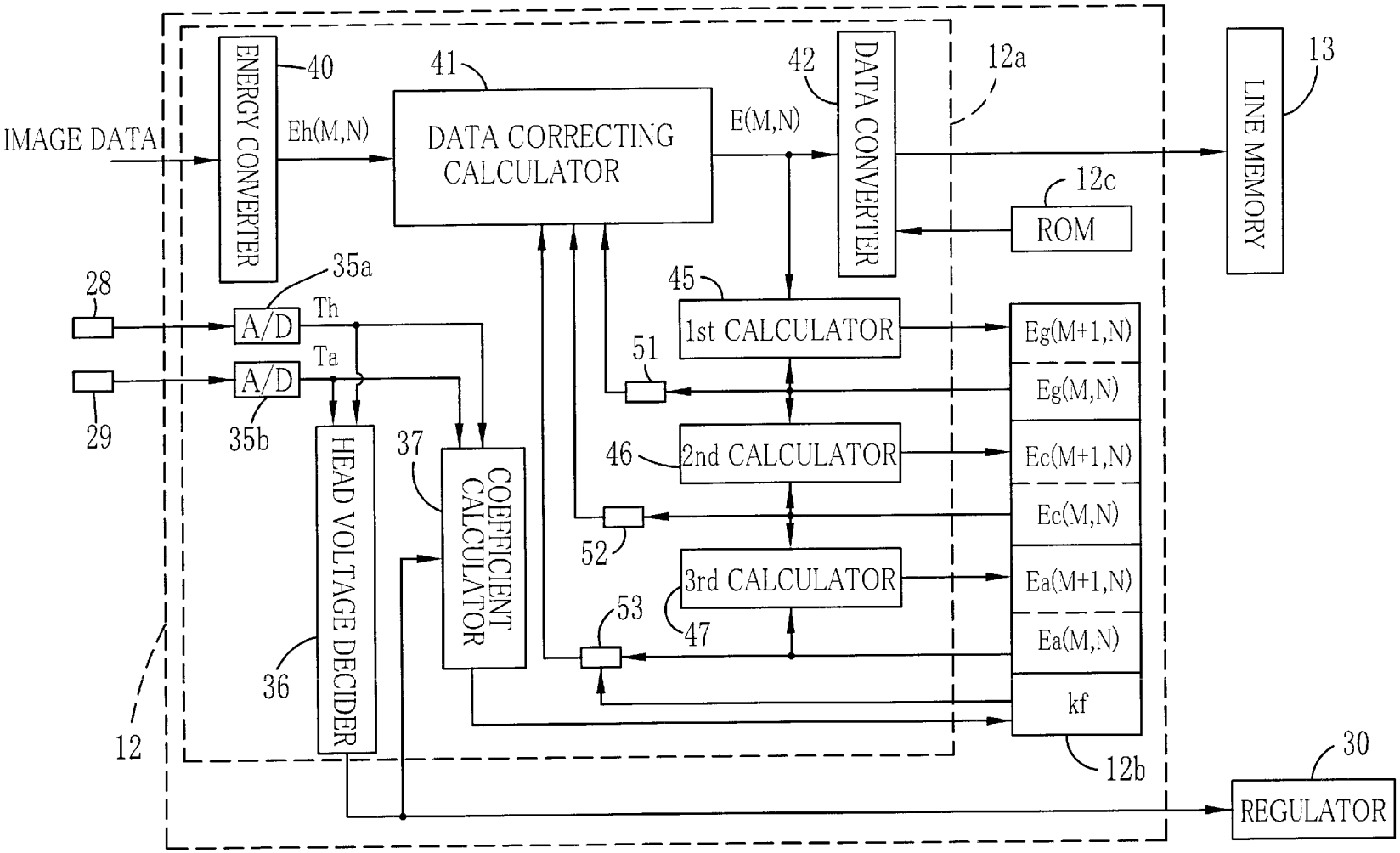
FIG. 3 is a block diagram of a data correcting section according to an embodiment of the present invention.

FIG. 3 shows the functional structure of the correcting section 12. The correcting section 12 is mainly constituted of a CPU 12*a*, a RAM 12*b* temporarily storing various data, and a ROM 12*c* storing many kinds of programs, coefficients and parameters which are necessary for calculating the head drive voltage Vp and correcting the image data.

The signals from the head temperature sensor 28 and the environmental temperature sensor 29 are respectively converted into digital data representative of a head temperature Th and that of an environmental temperature Ta through A/D converters 35*a* and 35*b*. The temperature data Th and Ta are sent to a head voltage decider 36 and a coefficient calculator 37. The head voltage decider 36 calculates a proper head drive voltage Vp for the detected head temperature Th and the detected environmental temperature Ta, by applying the detected temperatures Th and Ta to a predetermined head voltage calculation formula that includes a reference head drive voltage Vt as a parameter. The reference head drive voltage Vt is a value predetermined to be applied across the heating elements 16*a* when the head temperature Th and the environmental temperature Ta are equal to a reference temperature Tt (Th=Ta=Tt). For instance, the reference temperature Tt is set at 23° C. The head drive voltage Vp determined by the head voltage decider 36 is sent as the head voltage data to the regulator 30.

The head temperature sensor 28 and the environmental temperature sensor 29 perform the temperature measurement at the start of printing each color frame, and the head drive voltage Vp is adjusted correspondingly. That is, the head drive voltage Vp is kept unchanged during the recording of one color frame.

The head voltage data is fed also to the coefficient calculator 37. The coefficient calculator 37 calculates a coefficient Kf that represents a degree of influence of heat energy accumulated in the aluminum plate 23 on the recording, taking the changes of the head drive voltage Vp into account. The coefficient Kf is written on the RAM 12*b*.

Concretely, the coefficient Kf is calculated according to the following equation:

$$Kf=K6(Vp/Vt)^2\{1-Kh(Th-Tt)\}\{1-Ka\ (Th-Ta)\} \quad (1)$$

wherein

K6: coefficient considering heat transmission properties from the aluminum plate 23 to the thermosensitive recording sheet 15 and to the atmosphere around the aluminum plate 23;

Vt: reference head drive voltage;

Th: head temperature;

Ta: environmental temperature;

Tt: reference temperature;

Kh: correction coefficient for the head temperature Th; and

Ka: correction coefficient for a difference (Th−Ta) between the head temperature and the environmental temperature.

An energy converter 40 converts the input image data of each pixel into basic heating data that represents a heat energy value to be applied for recording a dot, that is, a total of a heat energy value for the bias heating and a heat energy value for the gradation heating. The basic heating data is sent to a data correcting calculator 41.

Converting the image data into the basic heating data contributes to simplifying calculation formulas for the data correction with respect to the heat accumulation in the thermal head 16. It is of course possible to use the bias data and the image data as the basic heating data insofar as the heat energy generated from the heating elements changes linearly or proportionally to the bias data and the image data.

The data correcting calculator 41 calculates data of a corrected heat energy amount, called the corrected heating data, on the basis of the basic heating data and first to third correction data. The first correction data corresponds to a heat energy value transmitted from the glazing layer 21 to the thermosensitive recording sheet 15, and the second correction data corresponds to a heat energy value transmitted from the ceramic substrate 22 to the thermosensitive recording sheet 15, whereas the third correction data corresponds to a heat energy value transmitted from the aluminum plate 23 to the thermosensitive recording sheet 15. The corrected heating data is sent to a data converter 42.

The data converter 42 makes a reverse conversion to that made by the energy converter 40. That is, a gradation heat energy value is obtained by subtracting the constant bias heating energy from the corrected heat energy amount represented by the corrected heating data, and then converted into corresponding image data. In this way, the image data alone is corrected while taking account of the heat accumulation resulted from the bias heating. It is of course possible to correct the bias data as well as the image data, or correct the bias data alone.

The present embodiment performs the data correction on the assumption that a fraction of heat energy accumulated in the glazing layer 21, the ceramic substrate 22 and the aluminum plate 23 is transmitted through the heating elements 16*a* to the thermosensitive recording sheet 15, and affects the density of the printed image.

Concretely, the basic heating data is corrected according to the following formula:

$$E_{(M,P)}=\{Eh_{(M,P)}-K2K3\cdot Eg_{(M,P)}-K4K5\cdot Ec_{(M,P)}-Kf\cdot Ea_{(M,P)}\}/K1 \quad (2)$$

wherein

M: line serial number in a frame;

P: pixel serial number in a line;

$E_{(M,P)}$: corrected heating data for the Nth pixel of line #M;

$Eh_{(M,P)}$: basic or uncorrected heating data for the Nth pixel of line #M;

$Eg_{(M,P)}$: first heat accumulation data for the Nth pixel of line #M, representative of a heat energy value accumulated in the glazing layer by the end of recording the preceding line #M−1;

$Ec_{(M,P)}$: second heat accumulation data for the Nth pixel of line #M, representative of a heat energy value accumulated in the ceramic substrate by the end of recording the preceding line #M−1;

$Ea_{(M,P)}$: third heat accumulation data for the Nth pixel of line #M, representative of a heat energy value accumulated in the aluminum plate by the end of recording the preceding line #M−1.

Figure 4:
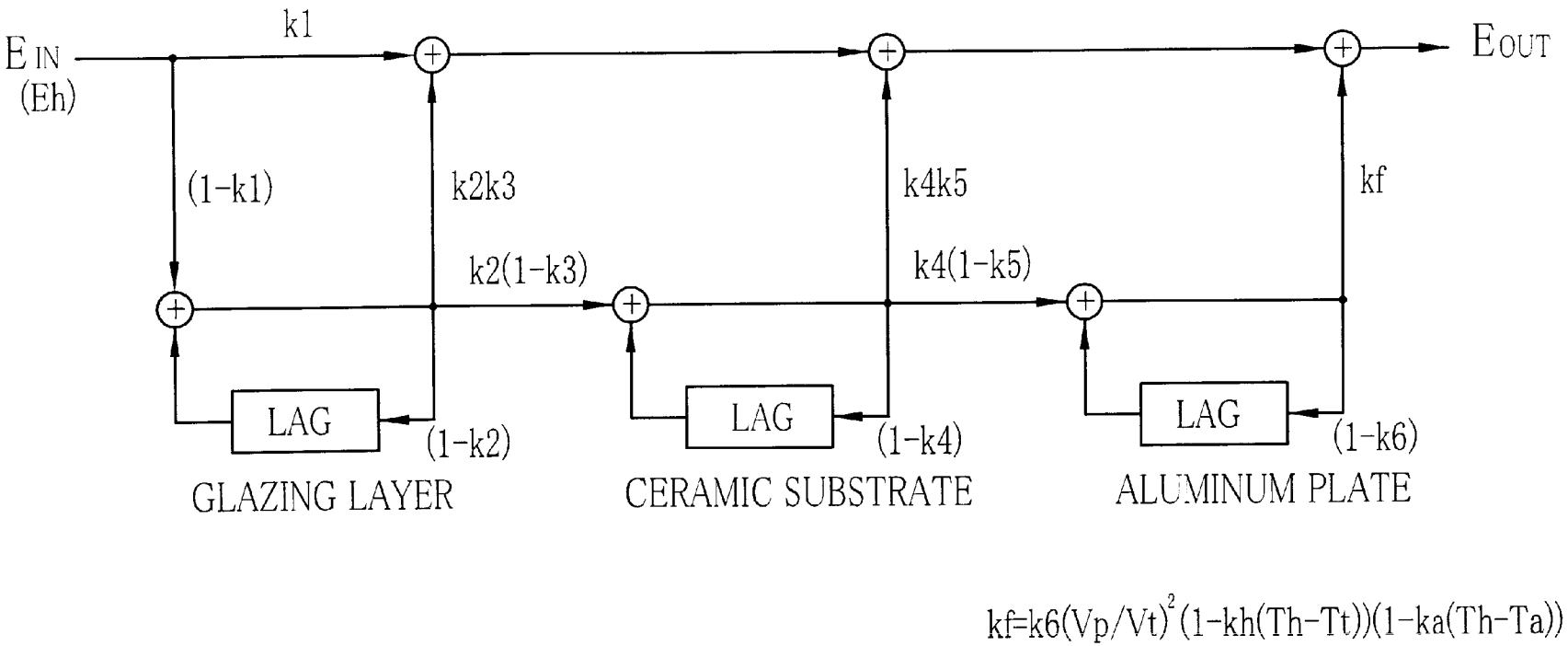
FIG. 4 is an explanatory diagram illustrating a circuit of heat accumulation in the thermal head.

As shown conceptually in FIG. 4, provided that $E_{OUT}$ represents a heat energy value that is actually applied to the thermosensitive recording sheet 15 if one heating element is driven in accordance with uncorrected original image data, and $E_{IN}$ represents a heat energy value expected to be applied to the thermosensitive recording sheet 15 for recording a dot at a density designated by the original image data, the heat energy value $E_{OUT}$ may be given as follows:

$$E_{OUT\,(M,P)}=K1\cdot E_{IN\,(M,P)}+K2K3\cdot Eg_{(M,P)}+K4K5\cdot Ec_{(M,P)}+Kf\cdot Ea_{(M,P)}$$

Because $Eh_{(M,P)}$ represents the heat energy value $E_{IN(M,P)}$ necessary for obtaining the designated recording density, the above formula (2) for calculating the corrected heating data $E_{(M,P)}$ may be obtained by substituting $Eh_{(M,P)}$ and $E_{(M,P)}$ for $E_{OUT(M,P)}$ and $E_{IN(M,P)}$ of the above equation respectively.

The first to third heat accumulation data are calculated in first to third heat accumulation calculators 45, 46 and 47 respectively. The first to third heat accumulation calculator 45, 46 and 47 correspond to the glazing layer 21, the ceramic substrate 22 and the aluminum plate 23 respectively. The first heat accumulation data represents a heat energy value accumulated in an individual portion of the glazing layer 21, the second heat accumulation data represents a heat energy value accumulated in an individual portion of the ceramic substrate 22, and the third heat accumulation data represents a heat energy value accumulated in an individual portion of the aluminum plate 23, wherein the individual portions mean virtual segments divided in correspondence with the heating elements 16*a*. The first to third heat accumulation data for one line are stored in the RAM 12*b*, and revised after each correction of one line of basic heating data.

Before the start of correcting the basic heating data for a line, hereinafter called line #M, i.e. by the end of correcting the basic heating data for the preceding line #M−1, the RAM 12*b* stores the first heat accumulation data for the line #M that represent heat energy values that have been accumulated to the end of recording of the line #M−1 in the individual portions of the glazing layer 21, the second heat accumulation data for the line #M that represent heat energy values that have been accumulated in the individual portions of the ceramic substrate 22 to the end of recording of the line #M−1, and the third heat accumulation data for the line #M that represent heat energy values that have been accumulated in the individual portions of the aluminum plate 23 to the end of recording of the line #M−1.

On correcting the basic heating data for the line #M, the first heat accumulation data for the line #M is serially sent from the RAM 12*b* to the first heat accumulation calculator 45, to the second heat accumulation calculator 46, and to a first coefficient multiplier 51, whereas the second heat accumulation data for the line #M is serially sent from the RAM 12*b* to the second heat accumulation calculator 46, to the third heat accumulation calculator 47, and to a second coefficient multiplier 52, and the third heat accumulation data for the line #M is serially sent from the RAM 12*b* to the third heat accumulation calculator 47, and to a third coefficient multiplier 53. After each correction of the basic heating data, the first heat accumulation calculator 45 receives the corrected heating data from the data correcting calculator 41.

The first to third coefficient multipliers 51 to 53 multiply the first to third heat accumulation data by predetermined coefficients, to calculate first to third correction data respectively.

The first coefficient multiplier 51 multiplies the first heat accumulation data by coefficients K2K3 to obtain the first correction data that represents a fraction of heat energy accumulated in the glazing layer 21, that is transmitted through the heating elements 16*a* to the thermosensitive recording sheet 15 and thus affects the recording. The second coefficient multiplier 52 multiplies the second heat accumulation data by coefficients K4K5 to obtain the second correction data that represents a fraction of heat energy accumulated in the ceramic substrate 22, that is transmitted through the heating elements 16*a* to the thermosensitive recording sheet 15 and thus affects the recording.

On the other hand, the coefficient Kf as calculated by the coefficient calculator 37 at the start of printing each color frame is read out from the RAM 12*b* and is set in the third coefficient multiplier 53. The third coefficient multiplier 53 multiplies the third heat accumulation data by the coefficient Kf to obtain the third correction data that represents a fraction of heat energy accumulated in the aluminum plate 23, that is transmitted through the heating elements 16*a* to the thermosensitive recording sheet 15 and affects the recording, wherein the influence of the changes of the head drive voltage Vp is taken into account.

The obtained first to third correction data are sequentially, i.e. for one pixel after another, sent from the coefficient multipliers 51 to 53 to the data correcting calculator 41. The data correcting calculator 41 adds up the first to third correction data for the same pixel, and subtracts the total value of the first to third correction data from the basic heating data of the corresponding pixel, and then divides the result of the subtraction by a coefficient K1, to obtain the corrected heating data that represents a heat energy value to be generated from the corresponding heating element 16*a* to record a dot at the designated density.

The first heat accumulation calculator 45 multiplies the corrected heating data for the line #M by a coefficient "1−K1", to calculate a fraction of heat energy generated from the heating elements 16*a*, that is transmitted not to the thermosensitive recording sheet 15 but to the glazing layer 21 and is accumulated in the glazing layer 21. The first heat accumulation calculator 45 also multiplies the first heat accumulation data for the line #M by a coefficient "1−K2", to calculate a fraction of heat energy that has been accumulated and stays accumulated in the glazing layer 21 to the end of recording the line #M. Thereafter, the first heat accumulation calculator 45 adds up these two calculation results for each pixel, and writes the sum as the first heat accumulation data for the next line #M+1 in the RAM 12*b*.

The second heat accumulation calculator 46 multiplies the first heat accumulation data for the line #M by a coefficient "K2(1−K3)", to calculate a fraction of heat energy that has been accumulated in the glazing layer 21 and is transmitted to and accumulated in the ceramic substrate 22. The second heat accumulation calculator 46 also multiplies the second heat accumulation data for the line #M by a coefficient "1−K4" to calculate a fraction of heat energy that has been accumulated and stays accumulated in the ceramic substrate 22 to the end of recording the line #M. Thereafter, the second heat accumulation calculator 46 adds up these two calculation results for each pixel, and writes the sum as the second heat accumulation data for the next line #M+1 in the RAM 12*b*.

The third heat accumulation calculator 47 multiplies the first heat accumulation data for the line #M by a coefficient "K4(1−K5)", to calculate a fraction of heat energy that has been accumulated in the ceramic substrate 22 and is transmitted to and accumulated in the aluminum plate 23. The third heat accumulation calculator 47 also multiplies the third heat accumulation data for the line #M by a coefficient "1−K4" to calculate a fraction of heat energy that has been accumulated and stays accumulated in the aluminum plate 23 to the end of recording the line #M. Thereafter, the third heat accumulation calculator 47 adds up these two calculation results for each pixel, and writes the sum as the third heat accumulation data for the next line #M+1 in the RAM 12*b*.

Consequently, the first to third heat accumulation data are revised according to the following formulas:

$$Eg_{(M+1,\ P)}=(1-K1)\cdot E_{(M,P)}+(1-K2)\cdot Eg_{(M,P)} \quad (3)$$

$$EC_{(M+1,\ P)}=K2(1-K1)\cdot Eg_{(M,P)}+(1-K4)\cdot EC_{(M,P)} \quad (4)$$

$$Ea_{(M+1,\ P)}=K4(1-K5)\cdot EC_{(M,P)}+(1-K6)\cdot Ea_{(M,P)} \quad (5)$$

The coefficients K1 to K6 are determined in a range from zero to "1", taking account of material, shapes and respective thermal conductivity of the heat accumulating layers 21 to 23, and other factors. The coefficient K1 is determined according to the shape of the thermal head 16, the material properties of the thermosensitive recording sheet 15, the degree of heat transmission from the heating elements 16*a* to the glazing layer 21, and other factors. The coefficient K1 is set the closer to zero, the more the heat energy generated from the heating elements 16*a* is apt to accumulate in the glazing layer 21. The coefficient K2 is determined according the material properties of the glazing layer 21, and the coefficient K3 is determined according to the rate of heat transmission from the glazing layer 21 to the thermosensitive recording sheet 15 and that from the glazing layer 21 to the ceramic substrate 22. The coefficient K2 is set the closer to "1", the more the heat is apt to be transmitted from the glazing layer 21 to other objects, and the less the heat stays in the glazing layer 21. The K3 is set the closer to "1", the larger fraction of the heat energy is transmitted from the glazing layer 21 to the thermosensitive recording sheet 15 among other objects.

In the same way, the K4 is set the closer to "1", the more the heat is apt to be transmitted from the ceramic substrate 22 to other objects, i.e. the thermosensitive recording sheet 15 and the aluminum plate 23 in this case, and the K5 is set the closer to "1", the larger fraction of the heat energy is transmitted from the ceramic substrate 22 to the thermosensitive recording sheet 15 among other objects. The K6 is set the closer to "1", the more the heat is apt to be transmitted from the aluminum plate 23 to other objects, i.e. the thermosensitive recording sheet 15 and the air around the aluminum plate 23 in this instance.

Now the overall operation of the above embodiment will be described.

After taking three color image data of a full-color image in the image memory 10, a print command is entered to start printing the full-color image. Then, the thermosensitive recording sheet 15 is placed in a print start position where the heating elements 16*a* of the thermal head 16 are pressed onto the thermosensitive recording sheet 15 and starts printing a yellow frame of the full-color image from a first line.

At the start of yellow recording, the CPU 12*a* takes up the signals from the head temperature sensor 28 and the environmental temperature sensor 29, and coverts the signals into the head temperature data Th and the environmental temperature data Ta through the A/D converters 35*a* and 35*b*. The signals from the head temperature sensor 28 and the environmental temperature sensor 29 are respectively converted into digital data representative of a head temperature Th and that of an environmental temperature Ta through A/D converters 35*a* and 35*b*. The temperature data Th and Ta are sent to the head drive voltage decider 36 and the coefficient calculator 37.

The head voltage decider 36 calculates a head drive voltage Vp for the yellowing recording on the basis of the detected head temperature Th and the detected environmental temperature Ta. If the temperatures Th and Ta are both equal to the reference temperature Tt, the head drive voltage Vp is set to be equal to the reference head drive voltage Vt. The head voltage data of the determined head drive voltage Vp is sent to the regulator 30, so the regulator 30 controls to output the head drive voltage Vp. The head voltage data is also sent to the coefficient calculator 37.

The coefficient calculator 37 calculates the coefficient Kf by applying the head drive voltage Vp, the head temperature Th and the environmental temperature Ta to the above formula (1), and writes the coefficient Kf in the RAM 12*b*. Thereafter, the coefficient Kf is set in the third coefficient multiplier 53.

Next, the yellow image data of the first line is read out from the image memory 10, and is written in the line memory 11. The yellow image data of the first line is transferred serially from the line memory 11 to the correcting section 12. As the yellow image data of the first pixel of the first line enters the energy converter 40, this data is converted into basic heating data Eh(1,1) that represents a heat energy value to be applied to the thermosensitive recording sheet 15 for recording a yellow dot at a density designated by that yellow image data. The basic heating data Eh(1,1) for the first pixel of the first line of the yellow frame is sent to the data correcting calculator 41.

When the basic heating data Eh(1,1) is fed in the data correcting calculator 41, the first, second and third heat accumulation data Eg(1,1), Ec(1,1) and Ea(1,1) for the first pixel of the first line are read out from the RAM 12*b*, and the first heat accumulation data Eg(1,1) is fed to the first and second heat accumulation calculators 45, 46 and to the first coefficient multiplier 51, whereas the second heat accumulation data Ec(1,1) is fed to the second and third heat accumulation calculating circuits 46, 47 and to the second coefficient multiplier 52. The third heat accumulation data Ea(1,1) is fed to the third heat accumulation calculator 47 and the third coefficient multiplier 53. As the heat accumulation data for the first line Eg(1,1), Ec(1,1) and Ea(1,1), appropriate values are previously written in the RAM 12*b*, which are for example calculated on the basis of the head temperature Th.

The first coefficient multiplier 51 multiplies the first heat accumulation data Eg(1,1) by the coefficients K2K3 to obtain the first correction data K2K3·Eg(1,1) for the first pixel of the first line. The second coefficient multiplier 52 multiplies the second heat accumulation data Ec(1,1) by coefficients K4K5 to obtain the second correction data K4K5·Ec(1,1) for the first pixel of the first line. The third coefficient multiplier 53 multiplies the third heat accumulation data Ea(1,1) by the coefficient Kf to obtain the third correction data Kf Ea(1,1) for the first pixel of the first line.

The obtained first to third correction data are sent to the data correcting calculator 41. The data correcting calculator 41 adds up the first to third correction data, and subtracts the sum from the basic heating data Eh(1,1), and then divides the result of the subtraction by the coefficient K1, to obtain the heating data E(1,1) that is corrected so as to compensate for the heat accumulation while taking account of the head drive voltage Vp. The corrected heating data E(1,1) is sent to the data converter 42 and the first heat accumulation calculator 45. The data converter 42 converts the corrected heating data E(1,1) into corrected yellow image data, and the corrected image data is written in the line memory 13 at a location corresponding to the first pixel.

Upon receipt of the corrected heating data E(1,1), the first heat accumulation calculator 45 newly calculates the first heat accumulation data Eg(2,1) for the first pixel of the second line, according to the formula (3) on the basis of the corrected heating data E(1,1) and the first heat accumulation data Eg(1,1) for the first pixel of the first line. The second heat accumulation calculator 46 newly calculates the second heat accumulation data Ec(2,1) for the first pixel of the second line, according to the formula (4) on the basis of the first and second heat accumulation data Eg(1,1) and Ec(1,1) for the first pixel of the first line. Also the third heat accumulation calculator 47 newly calculates the third heat accumulation data Ea(2,1) for the first pixel of the second line, according to the formula (5) on the basis of the second and third heat accumulation data Ec(1,1) and Ea(1,1) for the first pixel of the first line. The first to third heat accumulation data for the first pixel of the second line Eg(2,1), Ec(2,1) and Ea(2,1) are written in the RAM 12*a* in place of the first to third heat accumulation data for the first pixel of the first line Eg(1,1), Ec(1,1) and Ea(1,1).

After the yellow image data of the first pixel of the first line is corrected and the first to third heat accumulation data are revised in this way, the yellow image data of the second pixel of the first line is transferred from the line memory 10 to the energy converter 40, and is converted into basic heating data Eh(1,2).

When the basic heating data Eh(1,2) is fed in the data correcting calculator 41, the first to third heat accumulation data Eg(1,2), Ec(1,2) and Ea(1,2) for the second pixel of the first line are sent to the heat accumulation calculators 45 to 47 and the coefficient multipliers 51 to 53 in the same way as for the first pixel. The data correcting calculator 41 obtains the corrected heating data E(1,2) for the second pixel of the first line according to the formula (2) on the basis of the first to third correction data for the second pixel of the first line which are obtained through the coefficient multipliers 51 to 53 by multiplying the first to third heat accumulation data Eg(1,2), Ec(1,2) and Ea(1,2) by the respective coefficient K2K3, K4K5 and Kf.

The corrected heating data E(1,2) is sent to the data converter 42 and 45. The data converter 42 converts the corrected heating data E(1,2) into corrected yellow image data, and the corrected image data is written in the line memory 13 at a location corresponding to the second pixel.

The first heat accumulation calculator 45 newly calculates the first heat accumulation data Eg(2,2) for the second pixel of the second line, according to the formula (3) on the basis of the corrected heating data E(1,2) and the first eat accumulation data Eg(1,2) for the second pixel of the first line. The second heat accumulation calculator 46 newly calculates the second heat accumulation data Ec(2,2) for the second pixel of the second line, according to the formula (4) on the basis of the first and second heat accumulation data Eg(1,2) and Ec(1,2) for the second pixel of the first line. Also the third heat accumulation calculator 47 newly calculates the third heat accumulation data Ea(2,2) for the second pixel of the second line, according to the formula (5) on the basis of the second and third heat accumulation data Ec(1,2) and Ea(1,2) for the second pixel of the first line. The first to third heat accumulation data for the second pixel of the second line Eg(2,2), Ec(2,2) and Ea(2,2) are written in the RAM 12*a* in place of those for the second pixel of the first line Eg(1,2), Ec(1,2) and Ea(1,2).

The yellow image data of all pixels of the first line are corrected in the same way as above, while revising the first to third heat accumulation data. After the corrected yellow image data of all pixel of the first line is written in the line memory 13, the head driver 14 starts driving the heating elements 16a to record the first line of the yellow frame on the thermosensitive recording sheet 15. First the head driver 14 drives all the heating elements 16*a* at once in accordance with the bias data and a signal from the conduction time control circuit 27, for bias heating. Thereafter, the yellow image data of one line is transferred from the line memory 13 to the head driver 14, to drive the heating elements 16*a* selectively in accordance with the image data and signals from the conduction time control circuit 27, for gradation heating. During the bias heating and the gradation heating, the regulator 30 applies the head drive voltage Vp across the heating elements 16*a*.

While the first line is being recorded, the yellow image data of the second line is subjected to the correction process in the same way as for the first line on the basis of the first to third heat accumulation data for the second line that are written in the RAM 12*a* during the data correction process for the first line. Corrected yellow image data of the second line is written in the line memory 13. Also the first to third heat accumulation data for the third line are calculated on the basis of the corrected heating data for the second line and the first to third heat accumulation data for the second line, and the RAM 12*a* is revised with the first to third heat accumulation data for the third line.

After the first line is completely recorded, the thermosensitive recording sheet 15 is advanced by one line in the sub scan direction. Thereafter the second line of the yellow image is recorded by performing the bias heating based on the bias data, and the gradation heating based on the corrected yellow image data for the second line. The following lines of the yellow image are recorded on the basis of the yellow image data corrected in the same way as set forth above.

The thermosensitive recording sheet 15 having the yellow frame recorded thereon is exposed to the ultraviolet rays specific to the yellow thermosensitive coloring layer, to optically fix the yellow frame. When the yellow frame has been record and fixed to the last line, the thermal head 16 is set off the thermosensitive recording sheet 15, and the thermosensitive recording sheet 15 is conveyed back to the print start position. Then, the thermal head 16 is pressed onto the thermosensitive recording sheet 15 again, to start recording a magenta frame of the full-color image. At the start of magenta recording, the head temperature Th and the environmental temperature Ta are newly measured through the head temperature sensor 28 and the environmental temperature sensor 29, so the head drive voltage Vp is newly determined based on the head temperature Th and the environmental temperature Ta, and is set in the regulator 30. On the basis of the newly measured temperatures Th and Ta and the newly determined head drive voltage Vp, the coefficient Kf is newly calculated according the formula (1), and is written in the RAM 12*b* in place of the previous one.

Thereafter, the magenta image data is read out line by line from the image memory 10, and is written in the line memory 11. Then, the magenta image data is corrected sequentially for each pixel in the correcting section 12 according to the same process as for the yellow image data, wherein the coefficient Kf as revised at the start of magenta recording is used for calculating the third correction data for the heating data of magenta. Thus, magenta pixels are recorded line after line in accordance with the bias data for magenta and the corrected magenta image data, while the regulator 30 controls to apply the newly determined head drive voltage Vp across the heating elements 16*a*.

The thermosensitive recording sheet 15 having the magenta frame recorded thereon is exposed to the ultraviolet rays specific to the magenta thermosensitive coloring layer, to optically fix the magenta frame. When the magenta frame has been record and fixed to the last line, the thermal head 16 is set off the thermosensitive recording sheet 15, and the thermosensitive recording sheet 15 is conveyed back to the print start position. Then, the thermal head 16 is pressed onto the thermosensitive recording sheet 15 again, to start recording a cyan frame of the full-color image. At the start of cyan recording, the head temperature Th and the environmental temperature Ta are newly measured through the head temperature sensor 28 and the environmental temperature sensor 29, so the head drive voltage Vp is newly determined based on the head temperature Th and the environmental temperature Ta, and is set in the regulator 30. On the basis of the newly measured temperatures Th and Ta and the newly determined head drive voltage Vp, the coefficient Kf is newly calculated according the formula (1), and is written in the RAM 12*b* in place of the previous one.

Thereafter, the cyan image data is read out line by line from the image memory 10, and is written in the line memory 11. Then, the cyan image data is corrected sequentially for each pixel in the correcting section 12 according to the same process as for the yellow image data, wherein the coefficient Kf as revised at the start of cyan recording is used for calculating the third correction data for the heating data of cyan. Thus, cyan pixels are recorded line after line in accordance with the bias data for cyan and the corrected cyan image data, while the regulator 30 controls to apply the newly determined head drive voltage Vp across the heating elements 16*a*.

In this way, the heating data is corrected in accordance with conditions of the heat accumulation in the heat accumulating layers, i.e. the glazing layer 21, the ceramic substrate 22 and the aluminum plate 23, which are estimated accurately on the basis of the heat energy values that have been generated from the heating elements 16*a*, while taking the changes of the head drive voltage Vp into consideration. Therefore, the influence of heat accumulation on the recording density is well eliminated even where the head drive voltage is changed depending upon the environmental temperature and/or the thermal head temperature.

According to a test where an image whose original density is uniform in the sub scan direction was printed according to the present embodiment, it was proved that the density of the printed image was substantially unchanged in the sub scan direction even while the head drive voltage was changed according to the environmental temperature and the thermal head temperature. It was also proved that almost the same effect was achieved regardless of the environmental temperature, just by adjusting the coefficients K1 to K6, the correction coefficient Kh for the head temperature Th, and the correction coefficient Ka for the difference between the head temperature Th and the environmental temperature Ta, to be optimum for an appropriate environmental temperature.

Although the above embodiments calculate the first to third heat accumulation data for the glazing layer, the ceramic substrate and the aluminum plate, the number of kinds of the heat accumulation data, and thus the number of heat accumulation calculators may vary depending upon the number of heat accumulating layers of the thermal head. The CPU 12*a* may be replaced with a logic circuit or the like.

Figure 6:
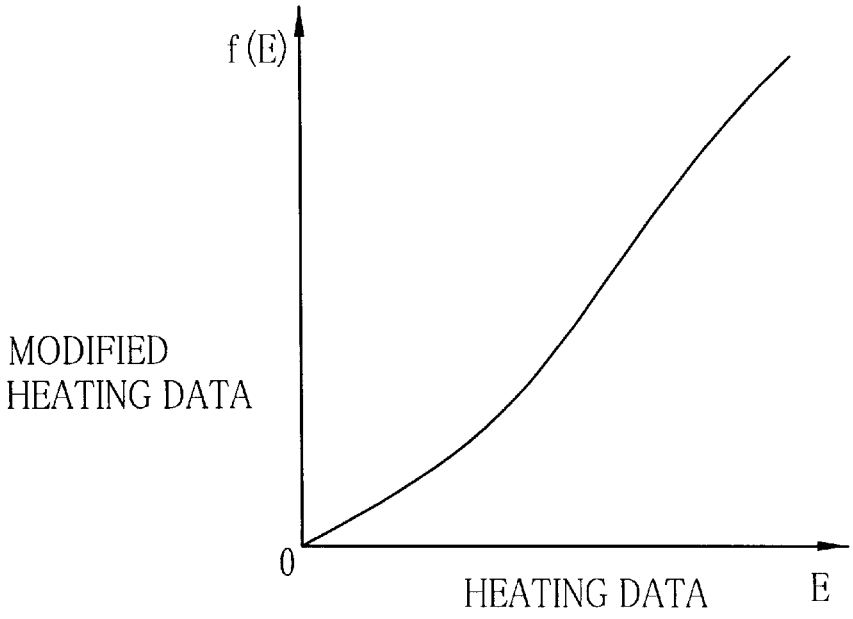
FIG. 6 is a graph illustrating a conversion curve f or modifying heating data according to the efficiency of heat transmission.

Now a data processing method according to a second embodiment of the invention will be described with reference to FIGS. 5 and 6. The second embodiment is applicable to the same thermal head as illustrated in FIG. 2, so the same reference numbers will be used for the second embodiment as for the first embodiment. In the second embodiment, conditions of heat energy accumulating in the respective heat accumulating layers 21 to 23 are estimated, taking the thermal conductivity of the glazing layer and the efficiency of heat transmission from the heating elements to the glazing layer 21 into consideration.

To take the thermal conductivity of the glazing layer 21 into consideration on estimating heat energy accumulated in the glazed layer 21, the glazed layer 21 is hypothetically divided into three layers arranged vertically from each other, and three heat accumulation values that represent different conditions of heat energy in the three hypothetically divided layers are calculated for each pixel. Therefore, the hypothetically divided first to third glazing layers G1, G2 and G3 may be regarded as first to third heat accumulating layers in the sequence from the side of the heating elements 16*a*, as shown in FIG. 5. Correspondingly, the ceramic layer 22 and the aluminum plate 23 may be regarded as fourth and fifth heat accumulating layers in this embodiment.

Therefore, five heat accumulation calculators and five coefficient multipliers are used in the second embodiment, to produce five kinds of correction data for each pixel by multiplying five kinds of heat accumulation data Eg1, Eg2, Eg3, Ec and Ea respectively by respectively predetermined coefficients. After the sum of the five correction data is subtracted from the basic heating data, the subsequent difference or the subtraction result is divided by a coefficient, to produce the corrected heating data.

Specifically, basic heating data obtained from the image data and the bias data for each pixel of each color is corrected according to the following formula:

$$E_{(M,P)}=\{Eh_{(M,P)}-K12K13\cdot Eg1_{(M,P)}-K14K15\cdot Eg2_{(M,P)}-K16K17\cdot Eg3_{(M,P)}-K18K19\cdot Ec_{(M,P)}-K20\cdot Ea_{(M,P)}\}/K11 \quad (I)$$

where in

M: line serial number in a frame;

P: pixel serial number in a line;

f(): function regarding heat transmission efficiency from the heating element to the glazing layer;

$E_{(M,P)}$: corrected heating data for the Nth pixel of line #M;

$Eh_{(M,P)}$: basic or uncorrected heating data for the Nth pixel of line #M;

$Eg1_{(M,P)}$: heat accumulation data for the Nth pixel of line #M, representative of a heat energy value accumulated in the first glazing layer G1 by the end of recording the preceding line #M−1;

$Eg2_{(M,P)}$: heat accumulation data for the Nth pixel of line #M, representative of a heat energy value accumulated in the second glazing layer G2 by the end of recording the preceding line #M−1;

$Eg3_{(M,P)}$: heat accumulation data for the Nth pixel of line #M, representative of a heat energy value accumulated in the third glazing layer G1 by the end of recording the preceding line #M−1;

$Ec_{(M,P)}$: second heat accumulation data for the Nth pixel of line #M, representative of a heat energy value accumulated in the ceramic substrate by the end of recording the preceding line #M−1;

$Ea_{(M,P)}$: third heat accumulation data for the Nth pixel of line #M, representative of a heat energy value accumulated in the aluminum plate by the end of recording the preceding line #M−1;

K11~K20: coefficients determined in a range from "0" to "1", taking account of materials, shapes and respective thermal conductivity of the heat accumulating layers 21 to 23, and other factors, in the same way as for the coefficients K1 to K6 of the first embodiment.

Figure 5:
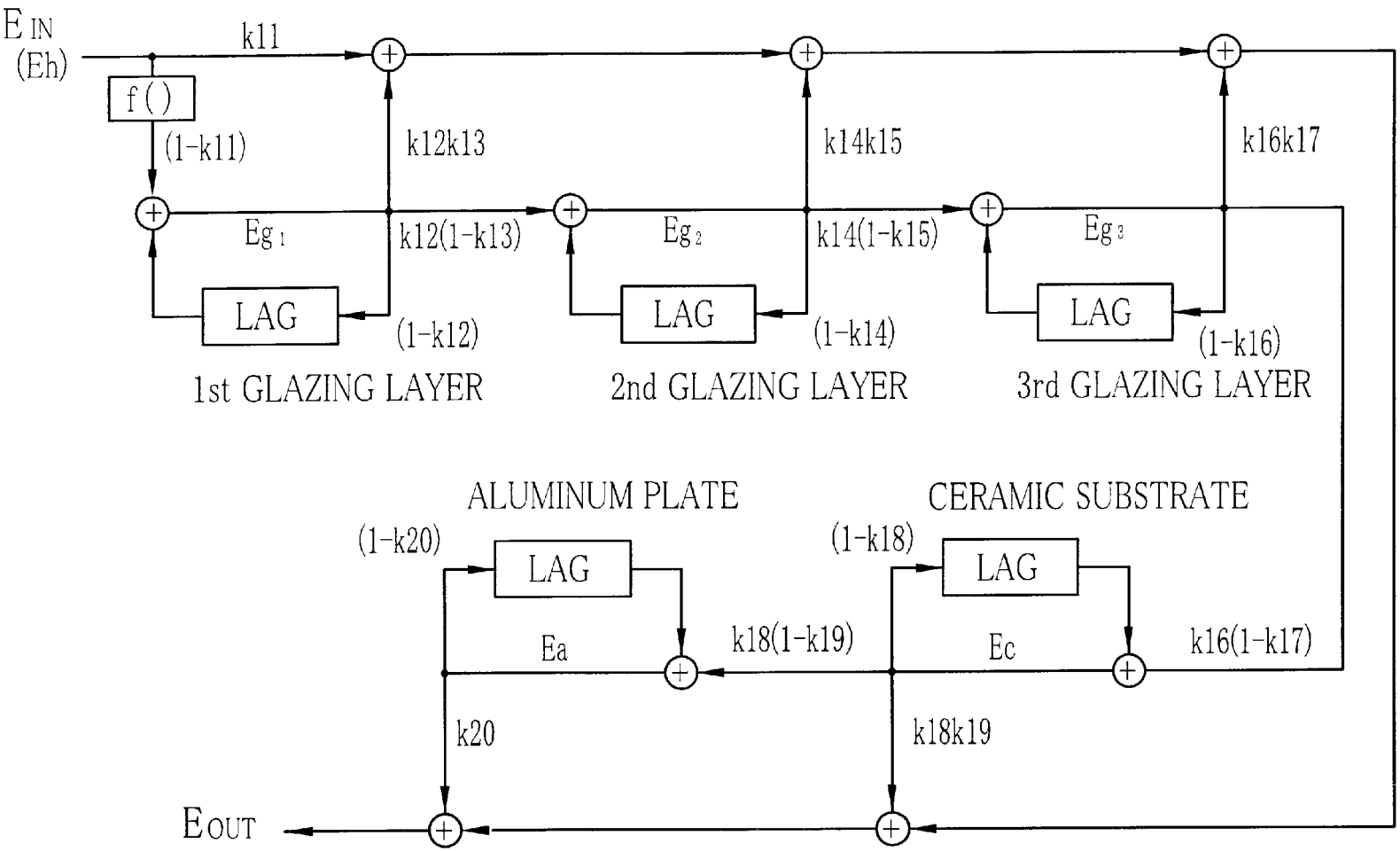
FIG. 5 is an explanatory diagram illustrating a circuit of heat accumulation in the thermal head, according to a second embodiment of the present invention.

As shown conceptually in FIG. 5, provided that $E_{OUT}$ represents a heat energy value that is actually applied to the thermosensitive recording sheet 15 if one heating element is driven in accordance with uncorrected original image data, and $E_{IN}$ represents a heat energy value expected to be applied to the thermosensitive recording sheet 15 for recording a dot at a density designated by the original image data, the heat energy value $E_{OUT}$ may be given as follows:

$$E_{OUT\,(M,P)}=K1\cdot E_{IN\,(M,P)}+K12K13\cdot Eg1_{(M,P)}+K14K15\cdot Eg2_{(M,P)}+K16K17\cdot Eg3_{(M,P)}+K18K19\cdot Ec_{(M,P)}+K20\cdot Ea_{(M,P)}$$

Because $Eh_{(M,P)}$ represents the heat energy value $E_{IN(M,P)}$ necessary for obtaining the designated recording density, the above formula (I) for calculating the corrected heating data $E_{(M,P)}$ may be obtained by substituting $Eh_{(M,P)}$ and $E_{(M,P)}$ for $E_{OUT(M,P)}$ and $E_{IN(M,P)}$ of the above equation respectively.

The heat accumulation data Eg1, Eg2, Eg3, Ec and Ea are revised after each correction of the basic heating data, on the basis of the corrected heating data and the present heat accumulation data Eg1, Eg2, Eg3, Ec and Ea, according to the following formulas:

$$Eg1_{(M+1,\,P)}=(1-K1)\cdot f(E_{(M,P)})+(1-K12)\cdot Eg1_{(M,P)} \quad (II)$$

$$Eg2_{(M+1,\,P)}=K12(1-K13)\cdot Eg1_{(M,P)}+(1-K14)\cdot Eg2_{(M,P)} \quad (III)$$

$$Eg3_{(M+1,\,P)}=K14(1-K15)\cdot Eg2_{(M,P)}+(1-K16)\cdot Eg3_{(M,P)} \quad (IV)$$

$$EC_{(M+1,\,P)}=K16(1-K17)\cdot Eg3_{(M,P)}+(1-K18)\cdot EC_{(M,P)} \quad (V)$$

$$Ea_{(M+1,\,P)}=K18(1-K19)\cdot EC_{(M,P)}+(1-K20)\cdot Ea_{(M,P)} \quad (VI)$$

The heat energy transmitted from the heating elements 16*a* to the first glazing layer G1 varies depending upon the heat energy generated from the heating elements 16*a* as they are driven. However, the transmitted heat energy does not change linearly or proportionally to the generated heat energy. That is, even while the heat energy generated from the heating element 16*a* doubles, the transmitted heat energy is not always doubled.

In view of this fact, the corrected heating data "$E_{(M,P)}$" is converted into modified heating data "$f(E_{(M,P)})$" through the function "f" of heat transmission efficiency, for calculating the heat accumulation data Eg1 for the first glazing layer G1 on the basis of the modified heating data, as shown in the above formula (II). Thereby, the condition of heat accumulation in the first glazing layer G1 is estimated based on the heat energy transmitted from the heating elements 16*a* to the first glazing layer G1, that is derived from the heat energy generated from the heating elements 16*a*, taking account of the heat transmission efficiency from the heating elements 16*a* to the glazing layer 21. FIG. 6 shows an example of this conversion.

The function "f", i.e., the non-linear relationship between the heating data and the modified heating data, is experimentally determined. It is possible to store the relationship between the heating data and the modified heating data as a calculation formula, and calculate the modified heating data from the corrected heating data each time the corrected heating data is entered. But in the present embodiment, the experimentally determined relationship between the heating data and the modified heating data is previously stored as a lookup table, and the corrected heating data is converted into the modified heating data with reference to the lookup table.

As for the heat accumulation data Eg2, Eg3, Ec and Ea for the second and third glazing layers and the ceramic substrate 22 and the aluminum plate 23, the respective heat accumulation data are calculated and revised on the basis of the present heat accumulation data for the corresponding heat accumulating layer and the present heat accumulation data for the adjacent upper heat accumulating layer, as seen from the above formulas (III), (IV), (V) and (VI).

As described so far, since the heat accumulation data Eg1 for the first glazing layer is calculated and revised on the basis of the modified heating data that is determined taking account of the heat transmission efficiency from the heating elements 16*a* to the glazed layer 21, the heat accumulation data Eg1 represents more accurately the heat accumulation in the first glazing layer G1. Since the heat accumulation data Eg1 has an influence on the heat accumulation data Eg2 for the next heat accumulating layer G2, and indirectly on the heat accumulation data Eg3, Eh and Ea for the following heat accumulating layers G3, the ceramic substrate 22 and the aluminum plate 23, the heat accumulation data represent more accurately the heat accumulation in the respective heat accumulating layers. Accordingly, influence of heat accumulation on the recording density is more exactly estimated and eliminated. As a result, even where the original image contains a high density portion, e.g. characters, in a middle density area, the gradation is finely reproduced in the printed image.

Although the second embodiment has been described on the assumption that the head drive voltage is maintained constant, the second embodiment is applicable to a case where the head drive voltage is adjusted according to the environmental temperature and the thermal head temperature, if only the change of the head drive voltage is taken into consideration when determining correction data on the basis of the heat accumulation data.

For example, the heat accumulation data Eg1 for the first glazing layer G1 is calculated and revised according to the following equation:

$$Eg\mathbf{1}_{(M+1,\ P)}=(1-K\mathbf{11})\cdot f(E_{(M,P)})\cdot g((Vp/Vt)^2)+(1-K\mathbf{12})\cdot Eg\mathbf{1}_{(M,P)} \quad \text{(VII)}$$

wherein $g((Vp/Vt)^2)$ represents a function for obtaining a coefficient for correcting the heat energy transmitted from the heating element to the first glazing layer G1, in accordance with a ratio of head drive voltage Vp to reference head drive voltage Vt. This function $g((Vp/Vt)^2)$ is experimentally determined.

It is also possible to estimate the heat accumulating condition of the glazing layer on the basis of the modified heating data $f(E_{(M,P)})$, without using the hypothetically divided glazing layers.

Although the above embodiments revise the heat accumulation data for each individual portion of one heat accumulating layer on the basis of the heating data for the corresponding heating element and the heat accumulation data for the corresponding portion of the adjacent heat accumulating layer, it is possible to revise the heat accumulation data according to a filtering operation using the heating data for those heating elements adjacent to the corresponding heating element, and the heat accumulation data for those portions surrounding the aimed portion, in addition to the heating data for the corresponding heating element and the heat accumulation data for the corresponding portion of the adjacent heat accumulating layer.

Although the present invention has been described with respect the thermosensitive recording type thermal printing, the present invention is applicable to the sublimation ink transfer type thermal printing in the same way. Besides the line printer as above, the present invention is applicable to a serial printer where the thermal head moves in a first direction while the recording sheet moves in a second direction perpendicular to the first direction.

Thus, the present invention should not be limited to the above described embodiments but, on the contrary, various modification may be possible to those skilled in the art without departing from the scope of claims attached hereto.

What is claimed is:

1. A data processing method for correcting heating data for a thermal head to eliminate influence of heat accumulation in the thermal head on recording density, the thermal head having an array of heating elements arranged in a line and first to Nth heat accumulating layers disposed under the heating elements in this order from the side of heating elements, the heating elements being driven in accordance with corrected heating data, to print one line after another on a recording sheet, one pixel of each line corresponding to one heating element of the array in regular sequence, wherein a drive voltage to be applied across the heating elements is determined according to a temperature of said Nth heat accumulating layer and an environmental temperature around the thermal head, the method comprising the steps of:

A. determining first to (N−1)th coefficients for said first to (N−1)th heat accumulating layers based on heat transmission properties between said first to Nth heat accumulating layers, and a Nth coefficient for said Nth heat accumulating layer based on the drive voltage for the thermal head and on the heat transmission properties between said first to Nth heat accumulating layers;

B. obtaining first to Nth correction data for each pixel of a subject line to print, by multiplying first to Nth heat accumulation data by said first to Nth coefficients respectively, said first to Nth heat accumulation data being representative of heat accumulation amounts in said first to Nth heat accumulation layers respectively, and previously stored in relation to each heating element of the array;

C. obtaining corrected heating data for each pixel of said subject line, from basic heating data representative of a heat energy value to be applied to said recording sheet for recording said pixel and said first to Nth correction data for said pixel;

D. obtaining a new series of first heat accumulation data by multiplying said corrected heating data of said subject line by a coefficient, multiplying said previously stored first heat accumulation data by a coefficient, and adding multiplication results in pixel-to-pixel correspondence;

E. obtaining a new series of Jth heat accumulation data, J being 2 to N, by multiplying said previously stored (J−1)th heat accumulation data by a coefficient, multiplying said previously stored Jth heat accumulation data by a coefficient, and adding multiplication results in pixel-to-pixel correspondence;

F. storing said new series of first to Nth heat accumulation data in place of said previously stored first to Nth heat accumulation data, while said subject line is printed in accordance with said corrected heating data; and G. repeating the above steps B to F for each line to print.

2. The data processing method as claimed in claim 1, wherein step C comprises the steps of:

subtracting said first to Nth correction data from said basic heating data of said subject line in pixel-to-pixel correspondence; and dividing subtraction results by a coefficient, to serve quotients as said corrected heating data of said subject line.

3. The data processing method as claimed in claim 1, wherein the drive voltage for the thermal head is determined for each frame of image based on the temperature of said Nth heat accumulating layer and the environmental temperature as measured at the start of printing said frame.

4. The data processing method as claimed in claim 1, wherein said Nth coefficient is determined according to the following formula:

$$Kf=K\mathbf{6}(Vp/Vt)^2\{1-Kh(Th-Tt)\}\{1-Ka(Th-Ta)\}$$

wherein

K6 represents a coefficient considering heat transmission properties from the Nth heat accumulating layer to the recording sheet and to atmosphere around the Nth heat accumulating layer;

Vt represents a reference drive voltage for the thermal head;

Th represents the temperature of said Nth heat accumulating layer;

Ta represents the environmental temperature;

Tt represents a reference temperature;

Kh represents a correction coefficient for the temperature Th; and

Ka represents a correction coefficient for a difference Th−Ta) between the temperature Th and the environmental temperature Ta.

5. A data processing method for correcting heating data for a thermal head to eliminate influence of heat accumulation in the thermal head on recording density, the thermal head having an array of heating elements arranged in a line and first to Nth heat accumulating layers disposed under the heating elements in this order from the side of heating elements, the heating elements being driven in accordance with corrected heating data, to print one line after another on a recording sheet, one pixel of each line corresponding to one heating element of the array in regular sequence, the method comprising the steps of:

A. obtaining first to Nth correction data for each pixel of a subject line to print, by multiplying first to Nth heat accumulation data by first to Nth coefficients respectively, said first to Nth heat accumulation data being representative of heat accumulation values in said first to Nth heat accumulation layers respectively, and previously stored in relation to each heating element of the array;

B. obtaining corrected heating data for each pixel of said subject line, from basic heating data representative of a heat energy value to be applied to said recording sheet for recording said pixel and said first to Nth correction data for said pixel;

C. converting said corrected heating data for said subject line, into modified heating data through a non-linear function that is predetermined based on heat transmission properties between the heating elements and said first heat accumulating layer;

D. obtaining a new series of first heat accumulation data by multiplying said modified heating data of said subject line by a coefficient, multiplying said previously stored first heat accumulation data by a coefficient, and adding multiplication results in pixel-to-pixel correspondence;

E. obtaining a new series of Jth heat accumulation data, J being 2 to N, by multiplying said previously stored (J−1)th heat accumulation data by a coefficient, multiplying said previously stored Jth heat accumulation data by a coefficient, and adding multiplication results in pixel-to-pixel correspondence;

F. storing said new series of first to Nth heat accumulation data in place of said previously stored first to Nth heat accumulation data, while said subject line is printed in accordance with said corrected heating data; and G. repeating the above steps A to F for each line to print.

6. The data processing method as claimed in claim 5, wherein step B comprises the steps of:

subtracting said first to Nth correction data from said basic heating data of said subject line in pixel-to-pixel correspondence; and dividing subtraction results by a coefficient, to serve quotients as said corrected heating data of said subject line.

7. The data processing method as claimed in claim 5, wherein said first to Nth coefficients are predetermined based on heat transmission properties between said first to Nth heat accumulating layers.

8. The data processing method as claimed in claim 5, wherein said heat accumulating layers of the thermal head comprise a glazing layer, a ceramic substrate and an aluminum plate laid on one another in this order from the side of heating element, and said glazing layer is hypothetically divided into a number of heat accumulating layers arranged vertically from each other, to obtain said heat accumulation data and said correction data for each of said hypothetically divided heat accumulating layers.

9. The data processing method as claimed in claim 5, wherein a drive voltage to be applied across the heating elements is determined according to a temperature of said Nth heat accumulating layer and an environmental temperature around the thermal head, and step D further comprises the step of multiplying said modified heating data by a coefficient determined based on a ratio of the drive voltage to a predetermined reference voltage.

10. A data processing apparatus for correcting heating data for a thermal head to eliminate influence of heat accumulation in the thermal head on recording density, the thermal head having an array of heating elements arranged in line and first to Nth heat accumulating layers disposed under he heating elements in this order from the side of heating elements, the heating elements being driven in accordance with corrected heating data, to print one line after another on a recording sheet, one pixel of each line corresponding to one heating element of the array in regular sequence, the data processing apparatus comprising:

a voltage determining means for determining a drive voltage to be applied to the thermal head, according to a temperature of said Nth heat accumulating layer and an environmental temperature around the thermal head;

a memory means for storing first to Nth heat accumulation data in relation to each heating element of the array, said first to Nth heat accumulation data being representative of heat accumulation amounts in said first to Nth heat accumulation layers respectively;

first to Nth multipliers multiplying said first to Nth heat accumulation data by first to Nth coefficients respectively, to obtain first to Nth correction data for each pixel of a subject line to print;

a coefficient determining means for determining said Nth coefficient based on heat transmission properties between said first to Nth heat accumulating layers, and on the drive voltage for the thermal head;

a correcting means for correcting basic heating data of said subject line, with said first to Nth correction data and a coefficient in pixel-to-pixel correspondence, to produce corrected heating data of said subject line, said basic heating data being representative of a heat energy value for each pixel to be applied to said recording sheet for recording said pixel;

a first calculator for obtaining a new series of first heat accumulation data by multiplying said corrected heating data of said subject line by a coefficient, multiplying said previously stored first heat accumulation data by a coefficient, and adding multiplication results in pixel-to-pixel correspondence; and second to Nth calculators for obtaining a new series of Jth heat accumulation data, J being 2 to N, by multiplying said previously stored (J−1)th heat accumulation data by a coefficient, multiplying said previously stored Jth heat accumulation data by a coefficient, and adding multiplication results in pixel-to-pixel correspondence, wherein said new series of first to Nth heat accumulation data are written on said memory device in place of said previously stored first to Nth heat accumulation data, during the recording of said subject line, and are used for obtaining first to Nth correction data for a next line to print.

11. The data processing apparatus as claimed in claim 10, wherein said correcting means subtracts said first to Nth correction data from said basic heating data of said subject line in pixel-to-pixel correspondence, and divides subtraction results by said coefficient, to serve quotients as said corrected heating data of said subject line.

12. The data processing apparatus as claimed in claim 10, wherein said heat accumulating layers of the thermal head comprise a glazing layer, a ceramic substrate and an aluminum plate as in this order from the side of heating element, and a head temperature sensor for measuring the temperature of said Nth heat accumulating layer is mounted in said aluminum plate.

13. The data processing apparatus as claimed in claim 11, wherein the drive voltage for the thermal head is determined for each frame of image based on the temperature of said Nth heat accumulating layer and the environmental temperature as measured at the start of printing said frame.

14. A data processing apparatus for correcting heating data for a thermal head to eliminate influence of heat accumulation in the thermal head on recording density, the thermal head having an array of heating elements arranged in a line and first to Nth heat accumulating layers disposed under the heating elements in this order from the side of heating elements, the heating elements being driven in accordance with corrected heating data, to print one line after another on a recording sheet, one pixel of each line corresponding to one heating element of the array in regular sequence, the data processing apparatus comprising:

a memory means for storing first to Nth heat accumulation data in relation to each heating element of the array, said first to Nth heat accumulation data being representative of heat accumulation values in said first to Nth heat accumulation layers respectively;

first to Nth multipliers for multiplying said first to Nth heat accumulation data by first to Nth coefficients respectively, to obtain first to Nth correction data for each pixel of a subject line to print;

a correcting means for correcting basic heating data of said subject line, with said first to Nth correction data and a coefficient in pixel-to-pixel correspondence, to produce corrected heating data of said subject line, said basic heating data being representative of a heat energy value for each pixel to be applied to said recording sheet for recording said pixel;

a conversion means for converting said corrected heating data for said subject line, into modified heating data through a non-linear function that is predetermined based on heat transmission properties between said heating elements and said first heat accumulating layer;

a first calculator for obtaining a new series of first heat accumulation data by multiplying said corrected heating data of said subject line by a coefficient, multiplying said previously stored first heat accumulation data by a coefficient, and adding multiplication results in pixel-to-pixel correspondence; and second to Nth calculators for obtaining a new series of Jth heat accumulation data, J being 2 to N, by multiplying said previously stored (J−1)th heat accumulation data by a coefficient, multiplying said previously stored Jth heat accumulation data by a coefficient, and adding multiplication results in pixel-to-pixel correspondence, wherein said new series of first to Nth heat accumulation data are written on said memory device in place of said previously stored first to Nth heat accumulation data, during the recording of said subject line, and are used for obtaining first to Nth correction data for a next line to print.

15. The data processing apparatus as claimed in claim 14, wherein said correcting means subtracts said first to Nth correction data from said basic heating data of said subject line in pixel-to-pixel correspondence, and divides subtraction results by said coefficient, to serve quotients as said corrected heating data of said subject line.

* * * * *